US007407413B2

(12) United States Patent
Minich

(10) Patent No.: US 7,407,413 B2
(45) Date of Patent: Aug. 5, 2008

(54) BROADSIDE-TO-EDGE-COUPLING CONNECTOR SYSTEM

(75) Inventor: Steven E. Minich, York, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/367,744

(22) Filed: Mar. 3, 2006

(65) Prior Publication Data

US 2007/0207674 A1 Sep. 6, 2007

(51) Int. Cl.
*H01R 13/648* (2006.01)

(52) U.S. Cl. ..... 439/608; 439/637; 439/941

(58) Field of Classification Search ..... 439/608, 439/941, 637, 79
See application file for complete search history.

(56) References Cited

U.S. PATENT DOCUMENTS

| | | | | |
|---|---|---|---|---|
| 2,664,552 | A | 12/1953 | Ericsson et al. | 339/192 |
| 3,115,379 | A * | 12/1963 | McKee | 439/290 |
| 4,030,792 | A | 6/1977 | Fuerst | 339/17 |
| 4,482,937 | A | 11/1984 | Berg | |
| 4,898,539 | A | 2/1990 | Glover et al. | 439/81 |
| 4,900,271 | A | 2/1990 | Colleran et al. | 439/595 |
| 5,004,426 | A | 4/1991 | Barnett | 439/82 |
| 5,046,960 | A | 9/1991 | Fedder | |
| 5,575,688 | A | 11/1996 | Crane, Jr. | 439/660 |
| 5,634,821 | A | 6/1997 | Crane, Jr. | 439/660 |
| 5,637,019 | A | 6/1997 | Crane, Jr. et al. | 439/677 |
| 5,980,321 | A | 11/1999 | Cohen et al. | 439/608 |
| 6,116,926 | A | 9/2000 | Ortega et al. | 439/108 |
| 6,179,663 | B1 | 1/2001 | Bradley et al. | 439/608 |
| 6,227,882 | B1 | 5/2001 | Ortega et al. | 439/101 |
| 6,293,827 | B1 | 9/2001 | Stokoe | 439/608 |
| 6,299,483 | B1 | 10/2001 | Cohen et al. | 439/608 |
| 6,302,711 | B1 | 10/2001 | Ito | 439/83 |
| 6,322,379 | B1 | 11/2001 | Ortega et al. | 439/108 |
| 6,328,602 | B1 | 12/2001 | Yamasaki et al. | 439/608 |
| 6,375,478 | B1 | 4/2002 | Kikuchi | |
| 6,379,188 | B1 | 4/2002 | Cohen et al. | 439/608 |
| 6,414,248 | B1 | 7/2002 | Sundstrom | |
| 6,464,529 | B1 | 10/2002 | Jensen et al. | |
| 6,503,103 | B1 | 1/2003 | Cohen et al. | |
| 6,506,076 | B2 * | 1/2003 | Cohen et al. | 439/608 |
| 6,540,522 | B2 | 4/2003 | Sipe | 439/61 |
| 6,551,140 | B2 | 4/2003 | Billman et al. | |
| 6,572,409 | B2 | 6/2003 | Nitta et al. | 439/608 |
| 6,592,381 | B2 | 7/2003 | Cohen et al. | |
| 6,672,907 | B2 | 1/2004 | Azuma | 439/682 |

(Continued)

*Primary Examiner*—Michael C Zarroli
(74) *Attorney, Agent, or Firm*—Woodcock Washburn LLP

(57) ABSTRACT

An electrical connector system is disclosed and may include a header connector and a receptacle connector. The contacts in the header connector may be edge-coupled to limit the level of cross-talk between adjacent signal contacts. For example, a differential signal in a first signal pair may produce a high-field in the gap between the contacts that form the signal pair, and a low-field near a second, adjacent signal pair. The contacts in the receptacle connector may be broadside-coupled and configured to receive the contacts from the header connector while minimizing signal skew. For example, the overall length of the contacts within a differential signal pair may be the same. The contacts in the connector system may include differential signal pairs, single-ended contacts, and/or ground contacts. The connector system may be devoid of any electrical shielding between the signal contacts.

28 Claims, 10 Drawing Sheets

U.S. PATENT DOCUMENTS 6,692,272 B2 * 2/2004 Lemke et al. ..... 439/108
6,695,627 B2 2/2004 Ortega et al. ..... 439/78
6,736,664 B2 5/2004 Ueda et al. ..... 439/423
6,746,278 B2 6/2004 Nelson et al. ..... 439/608
6,749,439 B1 6/2004 Potter et al. ..... 439/65
6,764,341 B2 7/2004 Lappoehn ..... 439/608
6,808,420 B2 10/2004 Whiteman, Jr. et al. ..... 439/608
6,843,686 B2 * 1/2005 Ohnishi et al. ..... 439/608
6,848,944 B2 2/2005 Evans
6,851,980 B2 2/2005 Nelson et al. ..... 439/608
6,893,686 B2 5/2005 Egan ..... 427/496
6,913,490 B2 7/2005 Whiteman, Jr. et al. ..... 439/608
6,918,789 B2 * 7/2005 Lang et al. ..... 439/608
6,945,796 B2 9/2005 Bassler et al.
6,979,215 B2 12/2005 Avery et al.
6,981,883 B2 * 1/2006 Raistrick et al. ..... 439/74
6,994,569 B2 2/2006 Minich et al.
7,021,975 B2 4/2006 Lappohn ..... 439/733.1
7,094,102 B2 * 8/2006 Cohen et al. ..... 439/608
7,108,556 B2 9/2006 Cohen et al. ..... 439/608
2003/0116857 A1 6/2003 Taniguchi et al.
2004/0224559 A1 11/2004 Nelson et al.
2004/0235321 A1 11/2004 Mizumura et al. ..... 439/92
2005/0032401 A1 2/2005 Kpbayashi ..... 439/76.2
2005/0170700 A1 8/2005 Shuey et al. ..... 439/701
2005/0196987 A1 9/2005 Shuey et al. ..... 439/108
2005/0215121 A1 9/2005 Tokunaga ..... 439/608
2005/0227552 A1 10/2005 Yamashita et al. ..... 439/862
2006/0024983 A1 2/2006 Cohen et al. ..... 439/61
2006/0068641 A1 3/2006 Hull et al. ..... 439/608
2006/0073709 A1 4/2006 Reid ..... 439/65
2006/0228912 A1 10/2006 Morlion et al. ..... 439/65
2006/0232301 A1 10/2006 Morlion et al. ..... 326/126

* cited by examiner

BROADSIDE-TO-EDGE-COUPLING CONNECTOR SYSTEM

CROSS-REFERENCE TO RELATED APPLICATIONS

The present application is related by subject matter to U.S. patent application Ser. No. 11/367,784, U.S. patent application Ser. No. 11/368,211, and U.S. patent application Ser. No. 11/367,745 the contents of each of which are hereby incorporated by reference in their entireties.

FIELD OF THE INVENTION

Generally, the invention relates to electrical connectors. More particularly, the invention relates to electrical connector systems having an interface for mating edge-coupled pairs of electrical contacts in a first connector with broadside-coupled pairs of electrical contacts in a second connector.

BACKGROUND OF THE INVENTION

Electrical connectors provide signal connections between electronic devices using signal contacts. Often, the signal contacts are so closely spaced that undesirable interference, or "cross-talk," may occur between adjacent signal contacts. As used herein, the term "adjacent" refers to contacts (or rows or columns of contacts) that are next to one another. Cross-talk may occur when one signal contact induces electrical interference in an adjacent signal contact due to intermingling electrical fields, thereby compromising signal integrity. With electronic device miniaturization and high-speed, high-signal integrity electronic communications becoming more prevalent, the reduction of cross-talk becomes a significant factor in connector design.

One commonly used technique for reducing cross-talk is to position separate electrical shields, in the form of metallic plates, for example, between adjacent signal contacts. The shields may act as a ground connection, thereby reducing cross-talk between the signal contacts by preventing the intermingling of the contacts' electrical fields. The metallic plates may be used to isolate an entire row or column of signal contacts from interfering electrical fields. In addition to, or in lieu of, the use of metallic plates, cross-talk may be reduced by positioning a row of ground contacts between signal contacts. Thus, the ground contacts may serve to reduce cross-talk between signal contacts in adjacent rows and/or columns.

As demand for smaller devices increases, existing techniques for reducing cross-talk may no longer be desirable. For instance, electrical shields and/or ground contacts consume valuable space within the connector, space that may otherwise be used to provide additional signal contacts and, thus, increase signal contact density. Furthermore, the use of shields and/or ground contacts may increase connector cost and weight. In some applications, shields are known to make up 40% or more of the cost of the connector.

In some applications, electrical connectors may be used to couple two or more devices with connecting surfaces that do not face each other (e.g., printed circuit boards that are perpendicular to each other). Such applications typically require right-angle connectors, which may use signal contacts with one or more angles. The total length of each signal contact in the connector may depend on the degree and/or the number of its angles. These variables are usually determined by the signal contact's relative position in the electrical connector. Consequently, some or all of the signal contacts in an angle connector may have different lengths. Signal skew typically occurs when two or more signals are sent simultaneously but are received at a destination at different times. Therefore, a need exists for a high-speed electrical connector that minimizes signal skew and reduces the level of cross-talk without the need for separate internal or external electrical shielding.

SUMMARY OF THE INVENTION

A high-speed connector system (i.e., one that should operate at data transfer rates above 1.25 Gigabits/sec (Gb/s) and ideally above about 10 Gb/s or more) is disclosed and claimed herein. Rise times may be about 250 to 30 picoseconds. For example, data rates of 1.5 to 2.5, 2.5 to 3.5, 3.5 to 4.5, 4.5 to 5.5, 5.5 to 6.5, 6.5 to 7.5, 7.5 to 8.5, 8.5 to 9.5, and 9.5-10 Gb/s and more are contemplated. Crosstalk between differential signal pairs may generally be six percent or less. The impedance may be about 100±10 Ohms. Alternatively, the impedance may be about 85±10 Ohms.

The system may include a header connector and a receptacle connector. The contacts in the header connector may be configured to limit the level of cross-talk between adjacent signal contacts. The contacts in the receptacle connector may be configured to receive the contacts from the header connector while minimizing signal skew. The signal contacts may include differential signal pairs or single-ended contacts. For example, each connector may include a first differential signal pair positioned along a first row of contacts and a second differential signal pair positioned adjacent to the first signal pair along a second row of contacts.

The connector system may be devoid of any electrical shielding between the signal contacts. The contacts in the connector system may be configured such that a differential signal in a first signal pair may produce a high electric-field in the gap between the contacts that form the signal pair, and a low electric-field near a second, adjacent signal pair. In addition, the contacts may be configured such that the overall length of the contacts within a differential signal pair may be the same. Contact density is approximated to be about 50 or more differential pairs per inch.

The connector system may also include novel contact configurations for reducing insertion loss and maintaining substantially constant impedance along the lengths of contacts. The use of air as the primary dielectric to insulate the contacts may result in a lower weight connector that is suitable for use in various connectors, such as a right angle ball grid array connector. Plastic or other suitable dielectric material may be used.

DETAILED DESCRIPTION OF ILLUSTRATIVE EMBODIMENTS

Figure 1A:
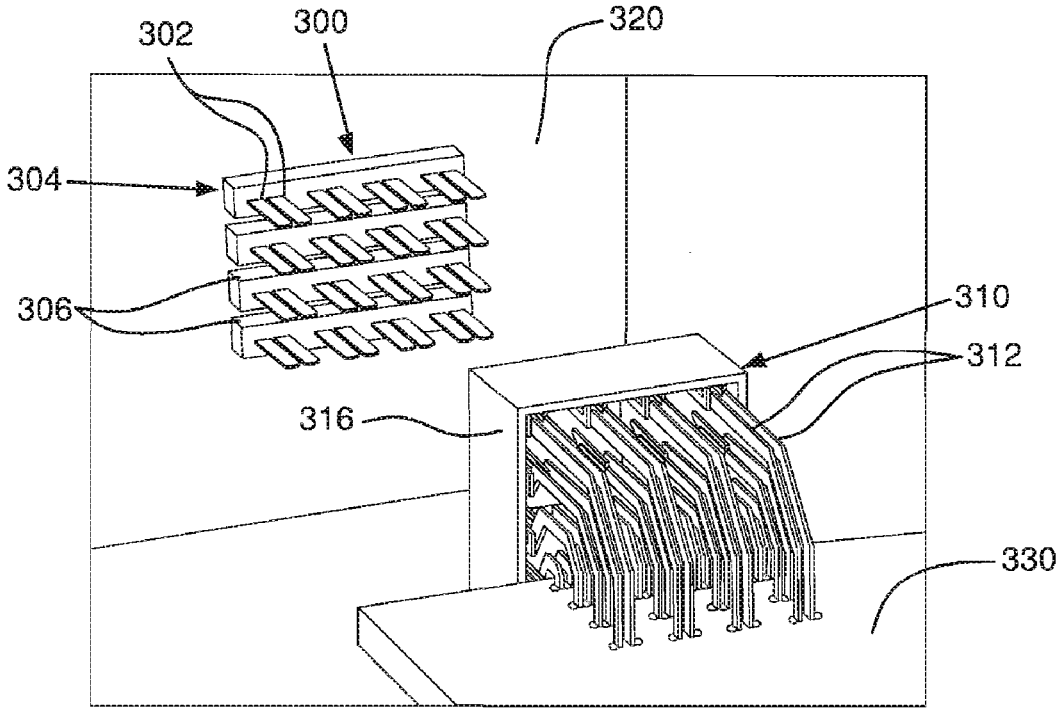
FIGS. 1A and 1B depict a connector system that includes a first connector having broadside-coupled electrical contacts and a second connector having edge-coupled electrical contacts.
Figure 1B:
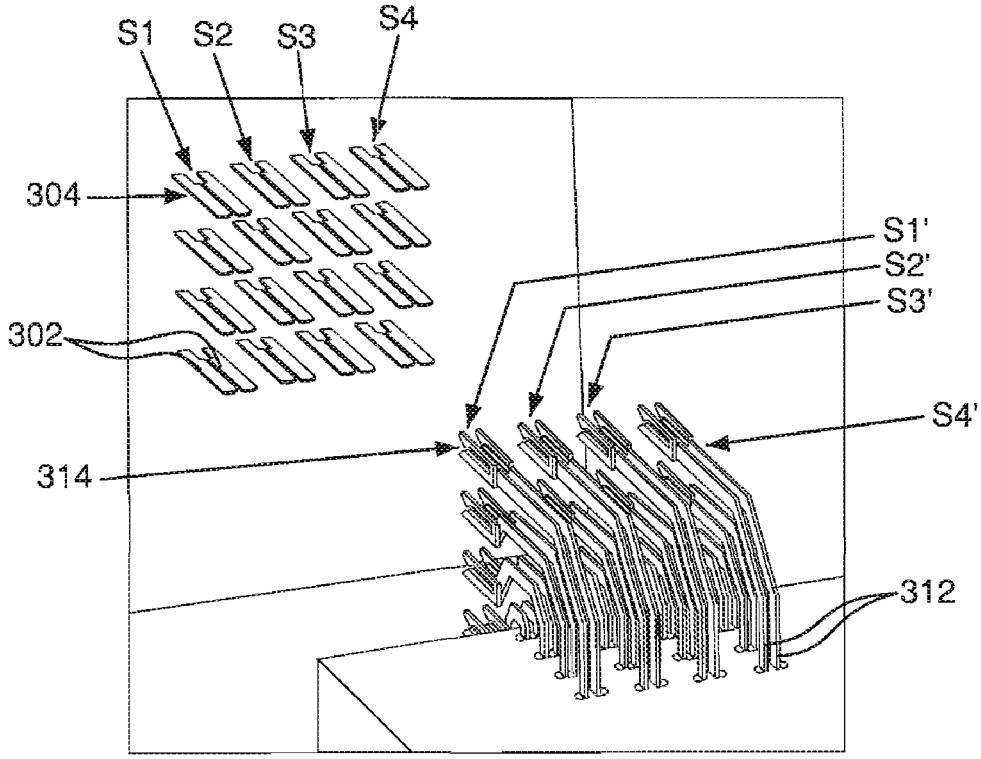

FIGS. 1A and 1B depict a connector system that includes a first connector 310 having an arrangement of broadside-coupled electrical contacts 312 and a second connector 300 having an arrangement of edge-coupled electrical contacts 302. The connector 300 may be a male, or plug, connector. The connector 310 may be a female, or receptacle, connector. The connector 300 may be a header connector, which may be mounted to a first circuit board 320, which may be a backplane. The connector 310 may be a right-angle connector, which may be mounted to a second circuit board 330, which may be a daughter card. The connector 310 may also be a mezzanine connector. The connectors 300, 310 may be mounted to their respective circuit boards 320, 330 via surface mount technology (SMT), solder ball grid array, press fit and the like.

An edge-coupled pair of electrical contacts 302 may form a differential signal pair. As shown in FIG. 1B, a linear array 304 of edge-coupled electrical contacts 302 may include one or more differential signal pairs S1-S4. Such a linear array 304 may also include one or more single-ended signal conductors, and one or more ground contacts. Such a linear array 304 may include any combination of differential signal pairs, single-ended signal conductors, and/or ground contacts.

A broadside-coupled pair of electrical contacts 312 may also form a differential signal pair. A linear array 314 of broadside-coupled electrical contacts 312 may include one or more differential signal pairs S1'-S4'. Such a linear array 314 may also include one or more single-ended signal conductors, and one or more ground contacts. Such a linear array 314 may include any combination of differential signal pairs, single-ended signal conductors, and/or ground contacts.

As shown in FIG. 1A, the connector 300 may include one or more dielectric leadframe housings 306, each of which may be molded over a respective linear array 304 of edge-coupled contacts 302. Thus, each of the edge-coupled electrical contacts 302 may extend through an associated dielectric leadframe housing 306. The connector 310 may include an optional dielectric housing 316 that surrounds the arrangement of broadside-coupled electrical contacts 312.

Rise times may be about 250 to 30 picoseconds. For example, data rates of 1.5 to 2.5, 2.5 to 3.5, 3.5 to 4.5, 4.5 to 5.5, 5.5 to 6.5, 6.5 to 7.5, 7.5 to 8.5, 8.5 to 9.5, and 9.5-10 Gb/s and more are contemplated. Crosstalk between differential signal pairs may generally be six percent or less. The impedance may be about 100±10 Ohms. Alternatively, the impedance may be about 85±10 Ohms.

Figure 2A:
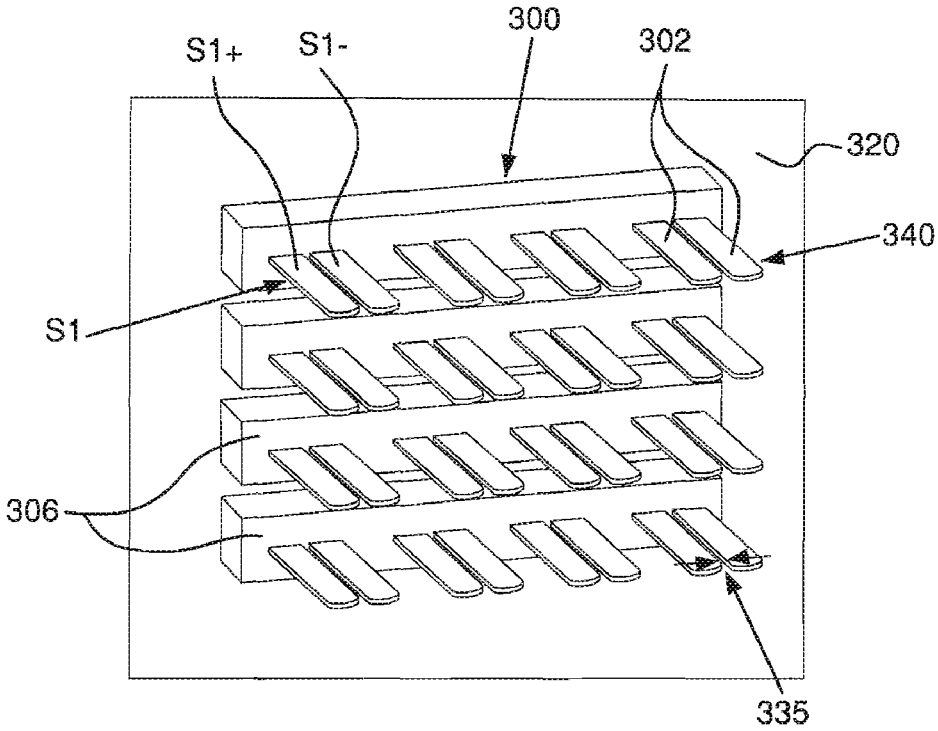
FIGS. 2A and 2B are perspective views of a portion of a male connector having an arrangement of edge-coupled pairs of electrical contacts.
Figure 2B:
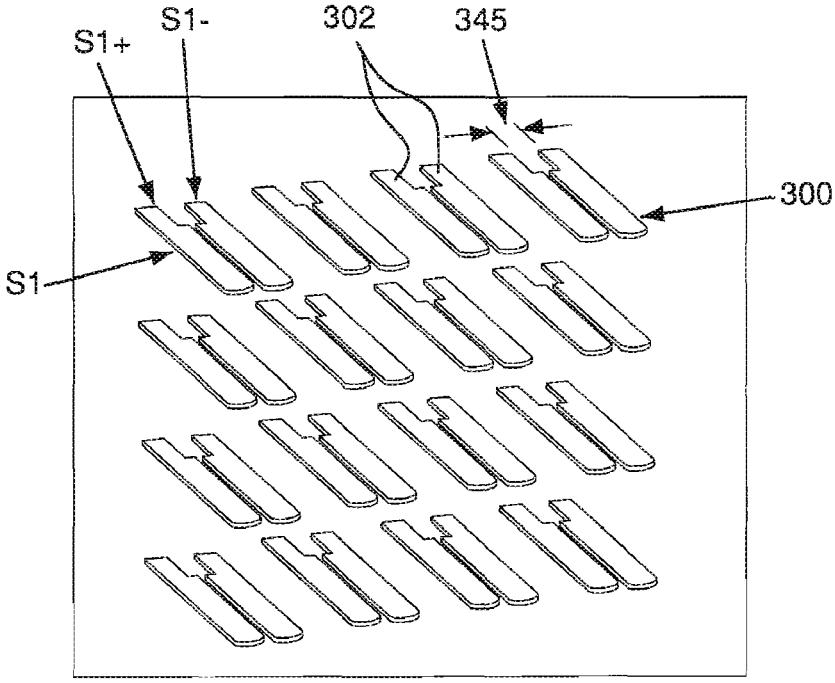

FIGS. 2A and 2B are perspective views of the connector 300, with and without the dielectric leadframe housings 306, respectively. As shown in FIG. 2A, the contacts 302 may have blade-shaped distal (e.g., mating) ends 340 that extend beyond the leadframe housings 306. The connector 300 may be coupled to the circuit board 320, which may be a backplane. The connector 300 may also include multiple differential signal pairs. For example, the connector 300 may include signal contacts S1+ and S1−, which may form a differential signal pair S1. The edges of the contacts 302 within a differential signal pair may be separated by a gap 335. The gap is preferably 0.3-0.4 mm in air and 0.5-0.9 mm in plastic.

Each differential signal pair may have a differential impedance, which may be the impedance existing between the contacts 302 in a differential signal pair (e.g., S1+ and S1−) at a particular point along the length of the differential signal pair. It is often desirable to control the differential impedance in order to match the impedance of the electrical device(s) to which the connector 300 is connected. Matching impedance may minimize signal reflection and/or system resonance, both of which can have the effect of limiting overall system bandwidth. Furthermore, it may be desirable to control the differential impedance such that it is substantially constant along the length of the differential signal pair. The differential impedance between the contacts 302 in the differential signal pair may be influenced by a number of factors, such as the size of the gap 335 and/or the dielectric coefficient of the matter or material in the gap 335.

As noted above, the mating ends 340 of the contacts 302 may be separated by a gap 335. The gap 335 may be an air gap, or it may be filled at least partially with plastic. The differential impedance between the contacts 302 in a differential signal pair may remain constant if the gap 335 and its dielectric coefficient remain constant along the length of the contacts 302. If there is a change in the dielectric coefficient, the gap 335 may be made larger or smaller in order to maintain a constant differential impedance profile. For example, as shown in FIG. 2B, the contacts 302 may be separated by a gap 345 as the contacts 302 pass through the leadframe housing (not shown in FIG. 2B), which may have a different dielectric coefficient than air. Thus, the gap 345 may be larger than the gap 335 in order to maintain a constant differential impedance profile as contacts 302 pass through the leadframe housing 306.

Figure 2C:
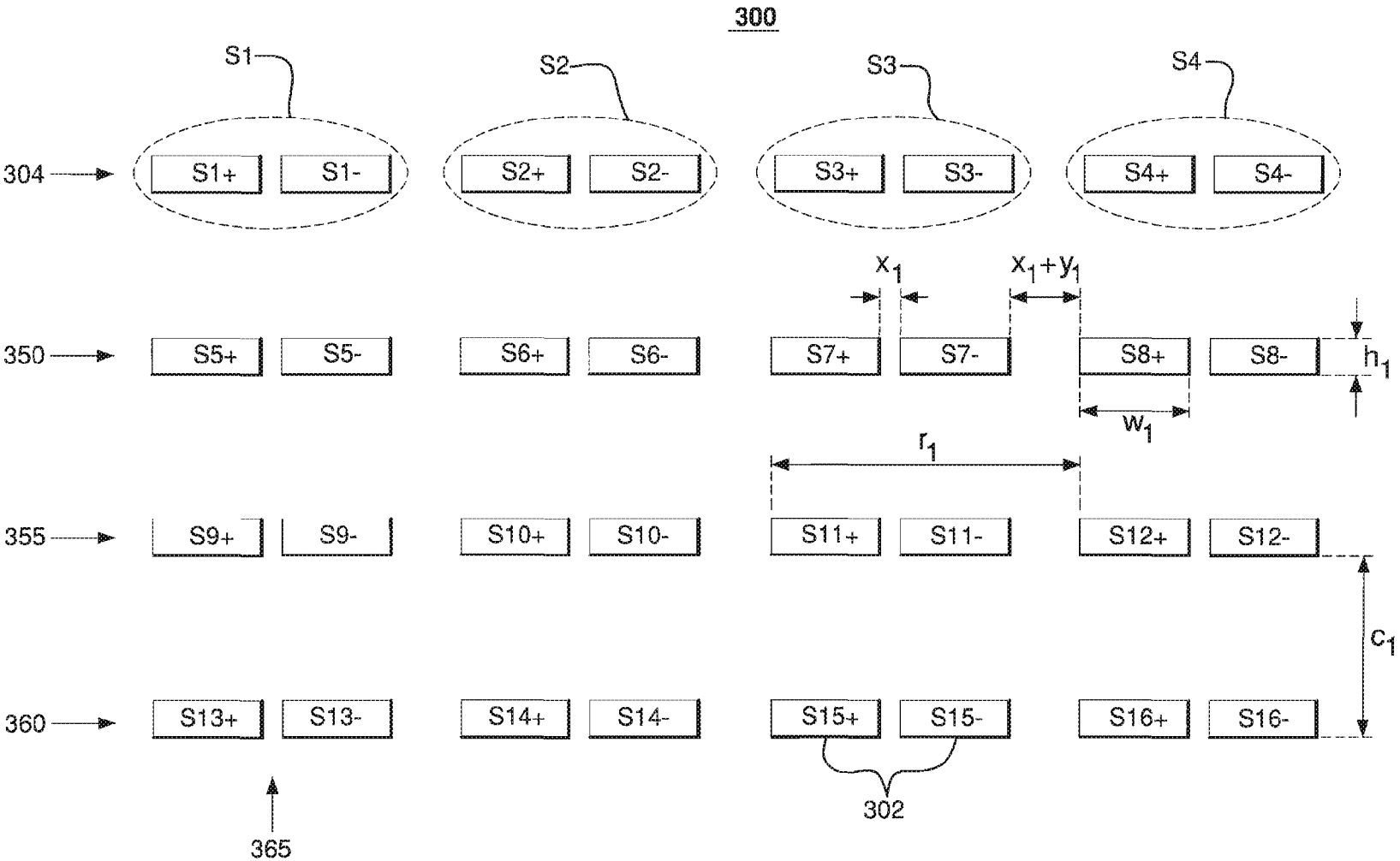
FIG. 2C depicts a contact arrangement in which edge-coupled pairs of electrical contacts are arranged in linear arrays.
Figure 5:
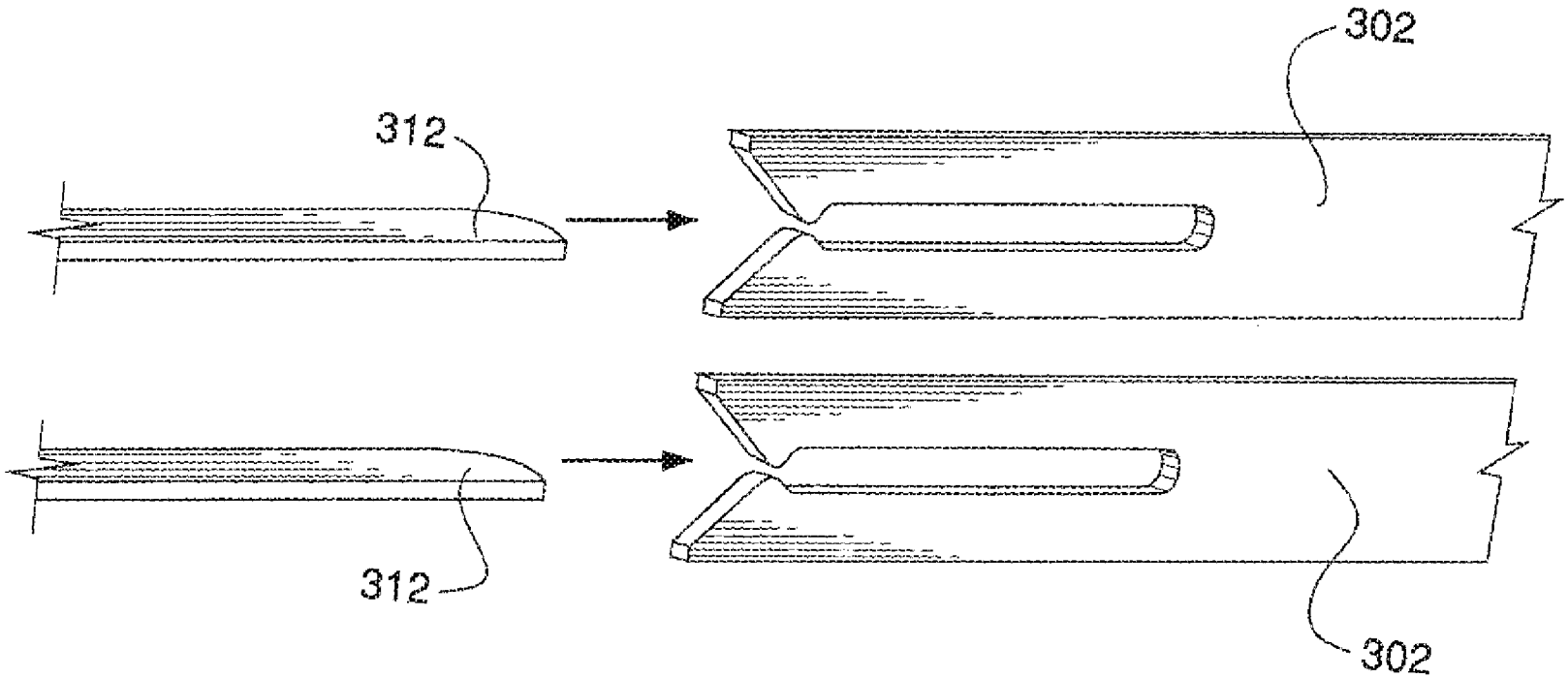
FIG. 5 is a detailed view of a broadside-to-edge-coupled mating interface extending from an edge-coupled pair of electrical contacts mating with a complementary pair of broadside-coupled electrical contacts.

FIG. 2C depicts a contact arrangement, viewed from the face of the header connector 300, in which edge-coupled differential signal pairs are arranged in linear arrays. The connector 300 may also have a broadside-coupled contact arrangement. The contacts 302 may include male mating ends (e.g., blade-shaped with a rectangular mating or intermediate portion cross-section), as shown in FIGS. 2A and 2B, and/or female (e.g., tuning-fork-shaped) mating ends, as shown in FIG. 5. As shown in FIG. 2C, the connector 300 may include differential signal pairs that are edge-coupled in rows. For example, a row 304 may include differential signal pairs S1, S2, S3 and S4, which may include signal contacts S1+ and S1−, S2+ and S2−, S3+ and S3−, and S4+ and S4−, respectively. A column 365, which may be perpendicular to the row 304, may include differential signal pairs S1, S5, S9 and S13. The rows 304, 350, 355 and 360 may include a total of sixteen differential signal pairs. It will be appreciated that the connector 300 may include any number and/or type of contacts (e.g., differential signal pairs, single-ended contacts, ground contacts, etc.) and may be arranged in rows and/or columns of various sizes.

The contacts 302 may have a width $w_1$ and a height $h_1$, which may be smaller than the width $w_1$. The contact pairs may have a column pitch $c_1$ and a row pitch $r_1$. The contacts 302 in a differential signal pair may be separated by a gap width $x_1$. As shown in FIG. 2C, the contact array may be devoid of ground contacts. In the absence of ground contacts, cross-talk may be reduced by separating adjacent differential signal pairs (e.g., S1 and S2) by a distance greater than $x_1$. For example, where the distance between contacts within each differential pair is $x_1$, the distance separating adjacent differential pairs in a row can be $x_1+y_1$, where $x_1+y_1/x_1>>1$.

Figure 2D:
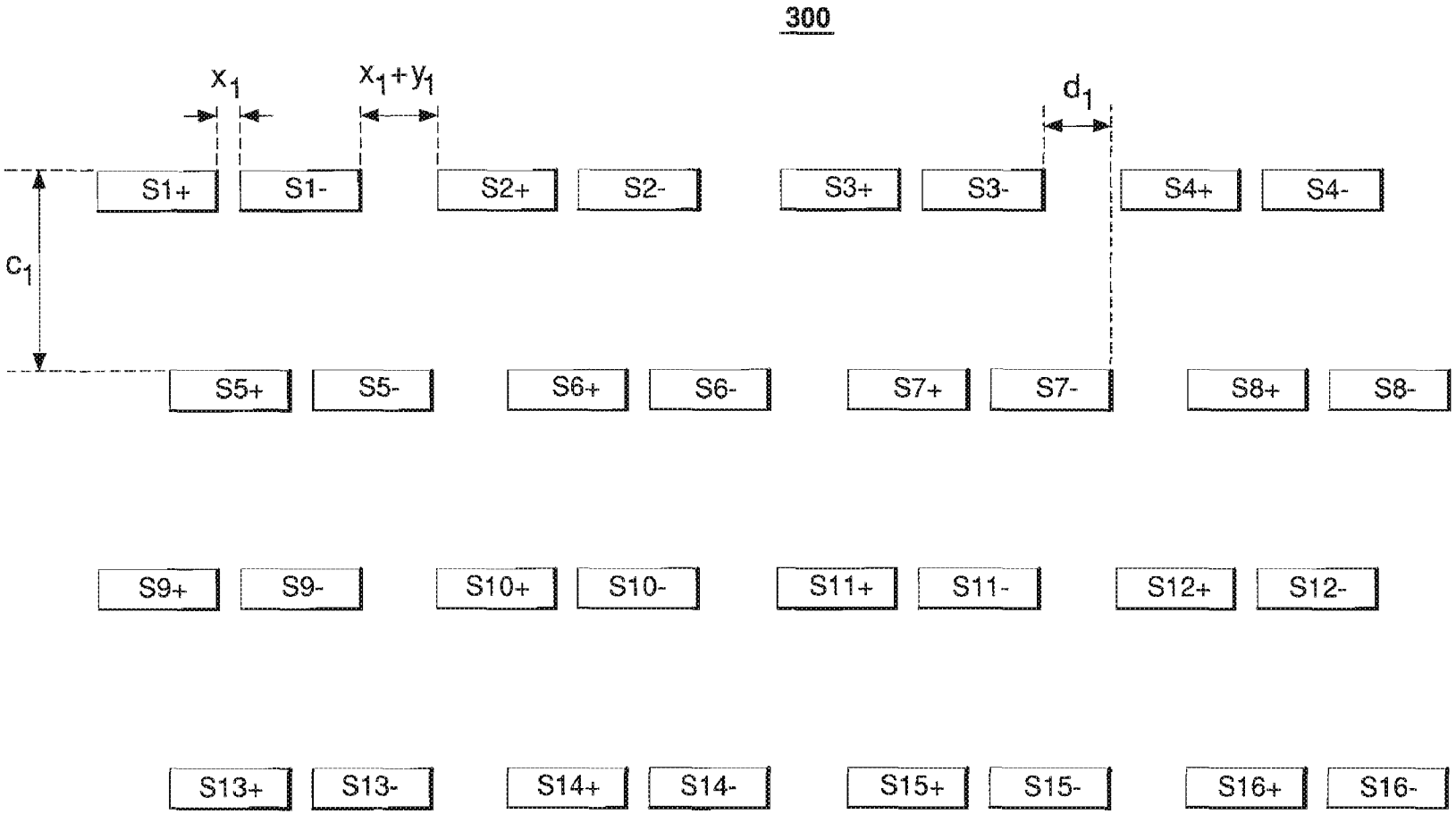
FIG. 2D depicts a contact arrangement in which adjacent linear arrays of edge-coupled pairs of electrical contacts are offset from one another.

FIG. 2D depicts a contact arrangement in which adjacent linear rows of edge-coupled differential signal pairs are offset from one another. Offsetting adjacent rows or columns of electrical contacts may reduce cross-talk. The amount of offset between adjacent rows or columns of electrical contacts may be measured from an edge of a contact 302 to the same edge of a corresponding contact 302 in an adjacent row or column. For example, as shown in FIG. 2D, the row 304 of contacts 302 may be offset from an adjacent row 350 of contacts 302 by an offset distance $d_1$. Offset distance $d_1$ may be varied until an optimum level of cross-talk between the adjacent contacts 302 has been achieved.

Cross-talk may also be reduced by varying the ratio of column pitch $c_1$ to gap width $x_1$. For example, a smaller gap width $x_1$ and/or larger column pitch $c_1$ may tend to decrease cross-talk between adjacent contacts 302. For instance, a smaller gap width $x_1$ may decrease the impedance between the contacts 302. In addition, a larger column pitch $c_1$ may increase the size of the connector 300. Yet, an acceptable level of cross-talk may be achieved with a smaller ratio (i.e., larger gap width $x_1$ and/or smaller column pitch $c_1$) by offsetting the adjacent rows of contacts 302 by an offset distance $d_1$.

Figure 3A:
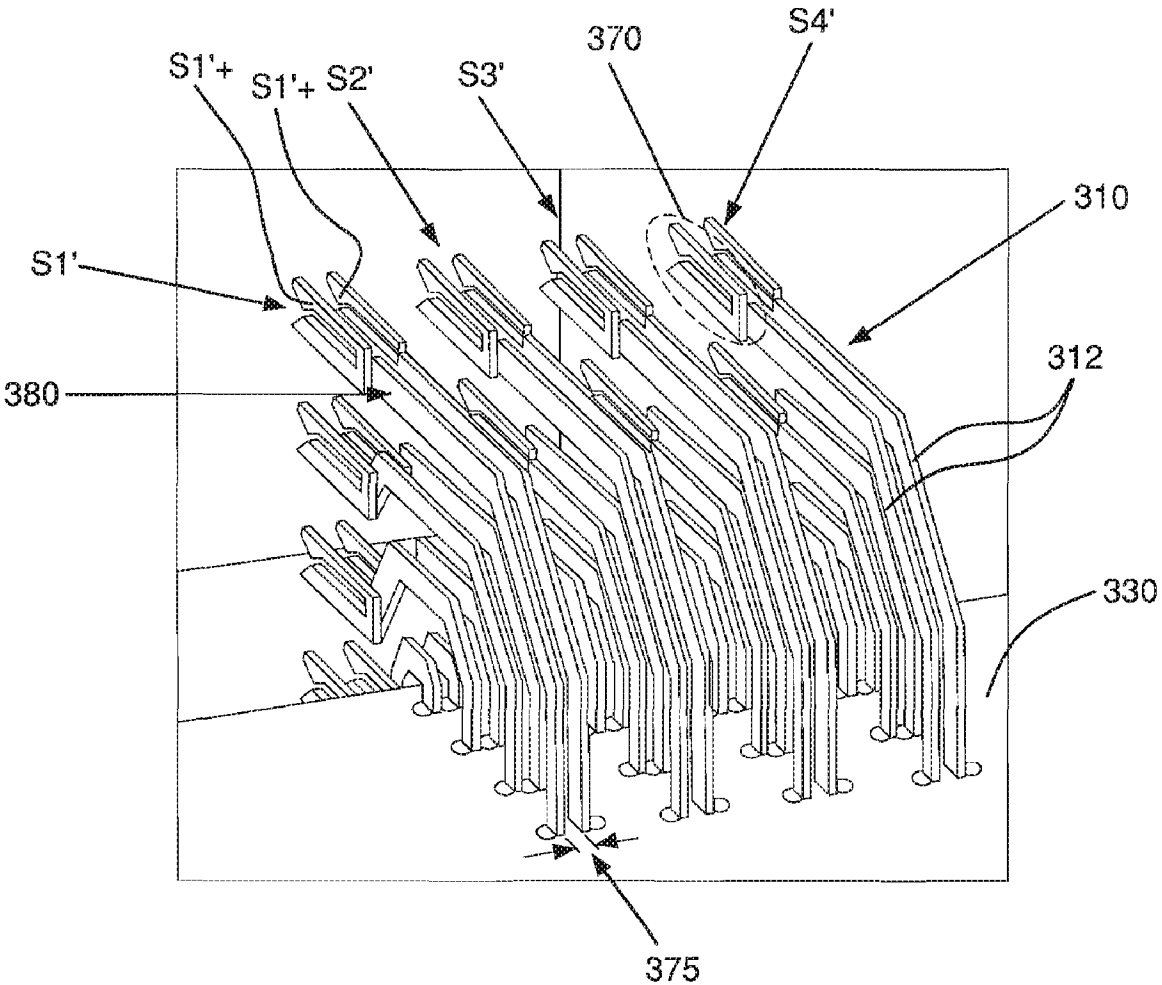
FIG. 3A is a perspective view of a portion of a female connector having an arrangement of broadside-coupled pairs of electrical contacts.

FIG. 3A is a perspective view of the connector 310 without the leadframe housing. As shown in FIG. 3A, the contacts 312 may have interface mating portions 370 that may be housed in the leadframe housing (not shown in FIG. 3A). For example, the interface mating portions 370 may include a receptacle with multiple tines that are adapted to receive the mating end 340 of a header pin contact 302 (see FIG. 2A). The contacts 312 may include lead portions 380, which may extend from the mating interface portions 370 and connect to the circuit board 330, which may be a daughter card. The lead portions 380 of the contacts 312 may be separated by a gap 375.

The connector 310 may be a right-angle connector. Thus, the lead portions 380 may define at least one angle such that the connector 310 may be capable of connecting two or more electronic devices with connecting surfaces that are substantially perpendicular to one another, such as the circuit boards 320 and 330. The connector 310 may also include multiple differential signal pairs. For example, the connector 310 may include signal contacts S1'+ and S1'−, which may form a differential signal pair S1'. The contacts 312 in a differential signal pair may have lead portions 380 that are broadside-coupled in the direction of a row and that are of equal length. Thus, signal skew between the contacts 312 in a differential signal pair and between the contacts 312 in the same row may be minimized.

Each differential signal pair may have a differential impedance, which may the impedance existing between the contacts 312 in a differential signal pair (e.g., S1'+ and S1'−) at a particular point along the length of the differential signal pair. It is often desirable to control the differential impedance in order to match the impedance of the electrical device(s) to which the connector 310 is connected. Matching impedance may minimize signal reflection and/or system resonance, both of which can have the effect of limiting overall system bandwidth. Furthermore, it may be desirable to control the differential impedance such that it is substantially constant along the length of the differential signal pair. The differential impedance between the contacts 312 in a differential signal pair may be influenced by a number of factors, such as the size of the gap 375 and/or the dielectric coefficient of the matter or material in the gap 375.

Thus, the differential impedance between the contacts 312 in a differential signal pair may remain constant if the gap 375 and its dielectric coefficient remain constant along the length of the contacts 312. However, any differences in the gap width and/or the dielectric coefficient between the contacts 302 in the connector 300 and the contacts 312 in the connector 310 may result in a non-uniform impedance profile when both connectors are mated to one another. Thus, the gap width and the dielectric coefficient between the contacts 312 in the connector 310 (e.g., S1+' and S1−') and between the contacts 302 in the connector 300 (e.g., S1+ and S1−) may be substantially the same.

Figure 3B:
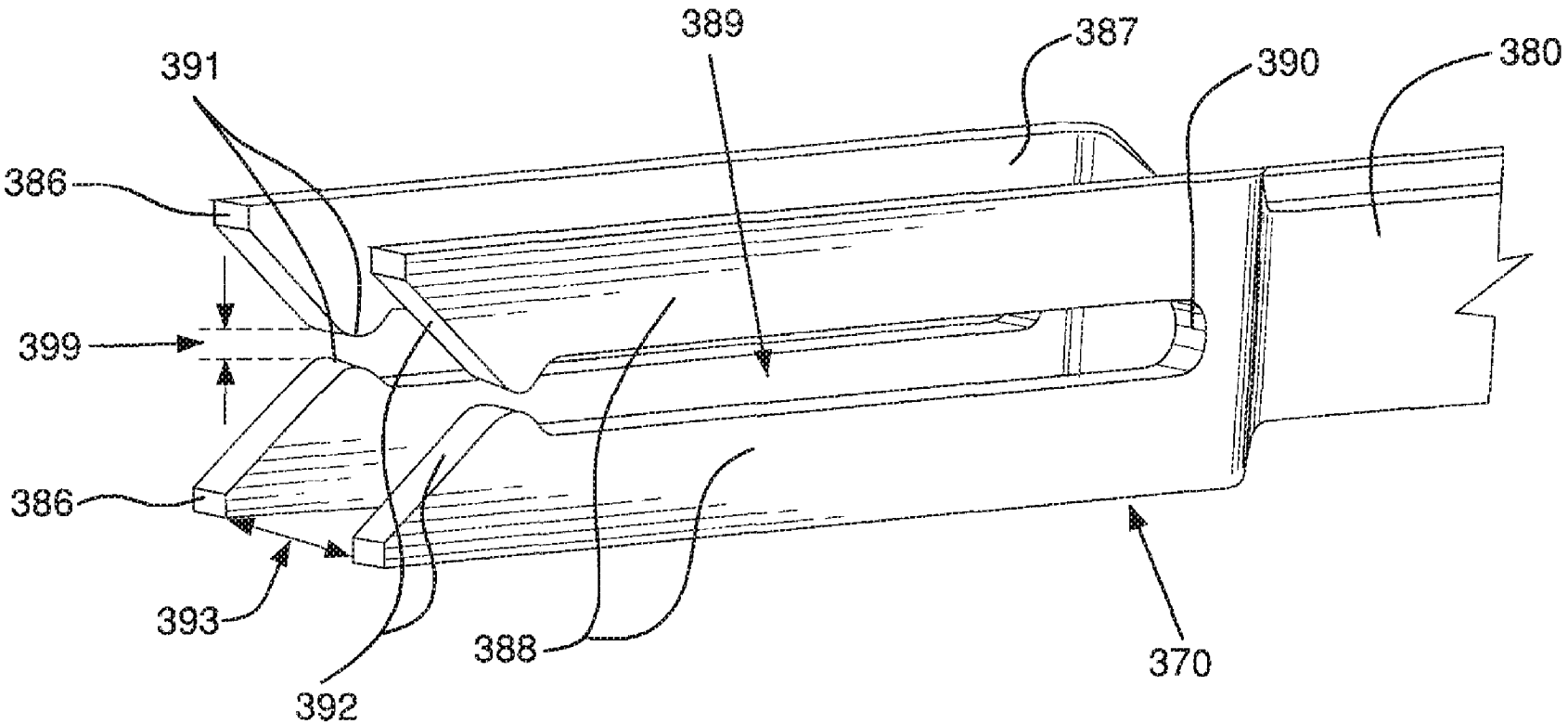
FIG. 3B is a detailed perspective view of a broadside-to-edge-coupled mating interface extending from a broadside-coupled pair of electrical contacts.

FIG. 3B is a detailed perspective view of a broadside-to-edge-coupled mating interface extending from a broadside-coupled pair of contacts 312. In particular, FIG. 3B illustrates the interface mating portions 370 of the contacts 312 in a differential signal pair. The mating interface portions 370 may be separated by a gap 393 and may have distal ends 386, which may be disposed at the opposite end from the lead portions 380. The transition between the mating interface portions 370 and the lead portions 380 may define a radius 387. That is, each mating interface portion 370 may jog toward or away from the other interface portion 370 of the pair. Thus, the gap 393 between the mating interface portions 370 of a pair may be greater than, equal to, or less than the gap 375 (see FIG. 3A) between the lead portions 380 that form the pair.

The mating interface portions 370 may also include tines 388, which may define a plane that is parallel to a plane defined by the lead portions 380. In addition, the tines 388 may define a plane that is perpendicular to a plane defined by the mating ends 340 of the contacts 302 in the connector 300 (see FIG. 2A). The tines 388 may define a slot 389, which may be adapted to receive the mating ends 340 of the contacts 302 in the connector 300. The closed-end of the slot 389 may define a radius 390.

Each mating interface portion 370 may also include protrusions 391, which may extend from the tines 388 into the slot 389. The protrusions 391 of each mating interface portion 370 may define a gap 399. It will be appreciated that the mating interface portions 370 have some ability to flex. Thus, the slot 399 may be smaller than the height $h_1$ of the mating end 340 when the mating interface portion 370 is not engaged with the mating end 340 and may enlarge when the mating interface portion 370 receives the mating end 340. Therefore, each protrusion may exert a force against each opposing side of the mating end 340, thereby mechanically and electrically coupling the mating interface portion 370 to the mating end 340 of the contact 302 in the connector 300. The protrusions 391 and the distal ends 386 may be linked via a sloped edge 392, which may serve as a guide to facilitate the coupling between the mating interface portions 370 and the mating ends 340 of the contacts 302.

Figure 3C:
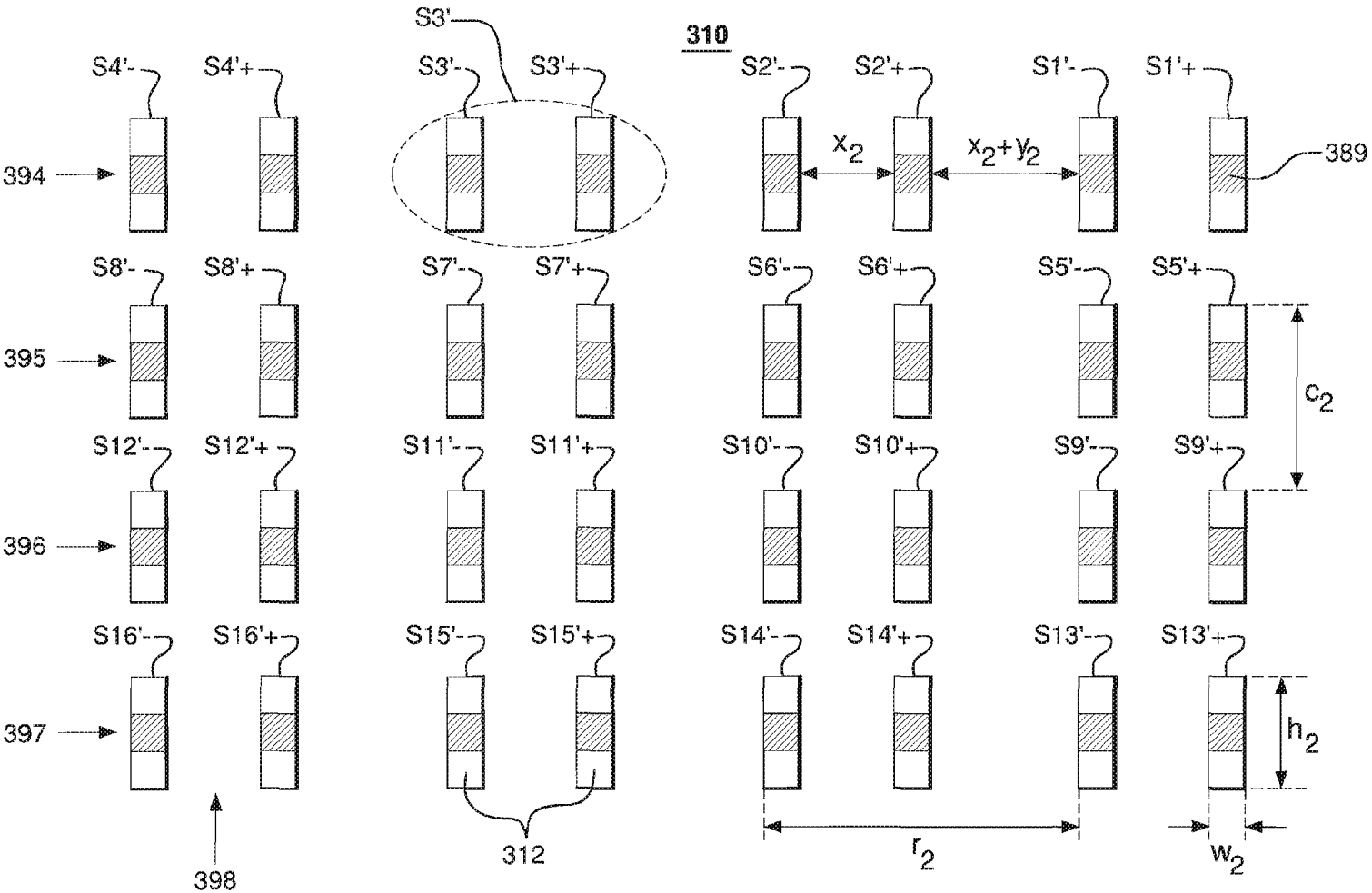
FIG. 3C depicts a contact arrangement in which broadside-coupled pairs of electrical contacts are arranged in linear arrays.

FIG. 3C depicts a contact arrangement, viewed from the face of the connector 310, in which broadside-coupled differential signal pairs are arranged in linear arrays. The connector 310 may have an edge-coupled contact arrangement. The contacts 312 may include male (e.g., blade-shaped) mating ends (as shown in FIG. 5), and/or female (e.g., tuning-fork-shaped) mating ends (as shown in FIG. 3A). As shown in FIG. 3C, the connector 310 may include differential signal pairs that are broadside-coupled in rows. For example, a row 394 may include differential signal pairs S4', S3', S2' and S1', which may include signal contacts S4'+ and S4'−, S3'+ and S3'−, S2'+ and S2'−, and S1'+ and S1'−, respectively. A column 398, which may be perpendicular to the row 394, may include differential signal pairs S4', S8', S12' and S16'. The rows 394, 395, 396 and 397 show sixteen exemplary differential signal pairs. It will be appreciated that the connector 310 may include any number and/or type of contacts (e.g., differential signal pairs, single-ended contacts, ground contacts, etc.) and may be arranged in rows and/or columns of various sizes.

The contacts 312 may have a width $w_2$ and a height $h_2$, which may be larger than the width $w_2$. The contact pair may have a column pitch $c_2$ and a row pitch $r_2$. The contacts 312 in a differential signal pair may be separated by a gap width $x_2$. It will be appreciated that one or more of the dimensions in the connector 310 may be equal to the dimensions in the connector 300. For example, the column pitch $c_2$ and the row pitch $r_2$ in the connector 310 may be equal to the column pitch $c_1$ and the row pitch $r_1$ in the connector 300.

As shown in FIG. 3C, the contact array may be devoid of ground contacts. In the absence of ground contacts, cross-talk may be reduced by separating adjacent differential signal pairs (e.g., S4' and S3') by a distance greater than $x_2$. For example, where the distance between the contacts 312 within each differential pair is $x_2$, the distance separating adjacent differential pairs in a row can be $x_2+y_2$, where $x_2+y_2/x_2>>1$.

Figure 3D:
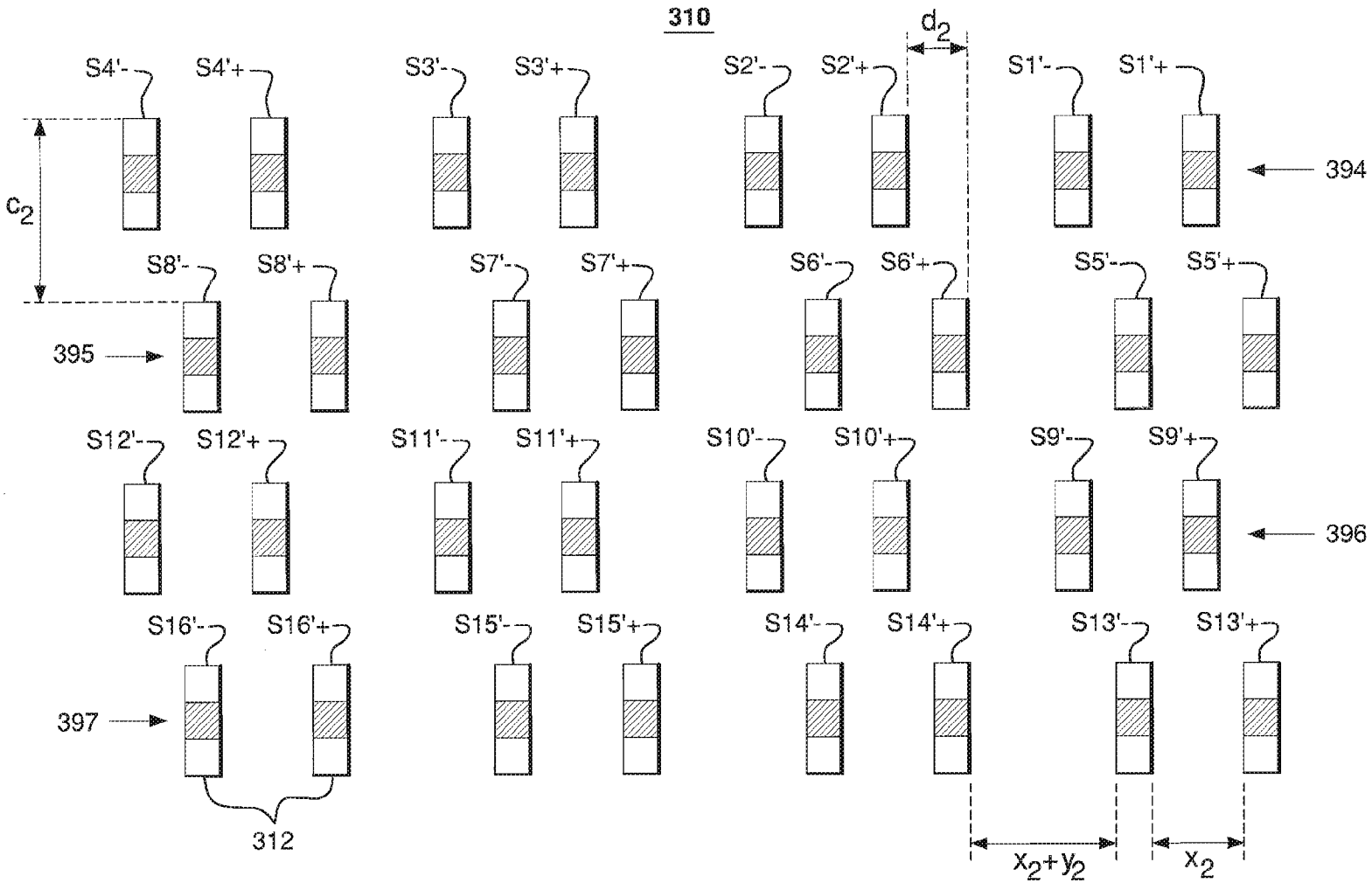
FIG. 3D depicts a contact arrangement in which adjacent linear arrays of broadside-coupled pairs of electrical contacts are offset from one another.

FIG. 3D depicts a contact arrangement in which adjacent linear rows of broadside-coupled differential signal pairs are offset from one another. Offsetting adjacent rows or columns of electrical contacts may reduce cross-talk. The amount of offset between adjacent rows or columns of the contacts 312 may be measured from an edge of a contact 312 to the same edge of a corresponding contact 312 in an adjacent row or column. For example, as shown in FIG. 3D, the row 394 of contacts 312 may be offset from the adjacent row 395 of contacts 312 by an offset distance $d_2$. Offset distance $d_2$ may be varied until an optimum level of cross-talk between the adjacent contacts 312 has been achieved. It will be appreciated that the offset distance $d_2$ may be equal to the offset distance $d_1$.

Cross-talk may also be reduced by varying the ratio of column pitch $c_2$ to gap width $x_2$. For example, a smaller gap width $x_2$ and/or larger column pitch $c_2$ may tend to decrease cross-talk between adjacent contacts 312. For instance, a smaller gap width $x_2$ may decrease the impedance between the contacts 312. In addition, a larger column pitch $c_2$ may increase the size of the connector 310. Yet, an acceptable level of cross-talk may be achieved with a smaller ratio (i.e., larger gap width $x_2$ and/or smaller column pitch $c_2$) by offsetting the adjacent rows of contacts 312 by an offset distance $d_2$.

Figure 4A:
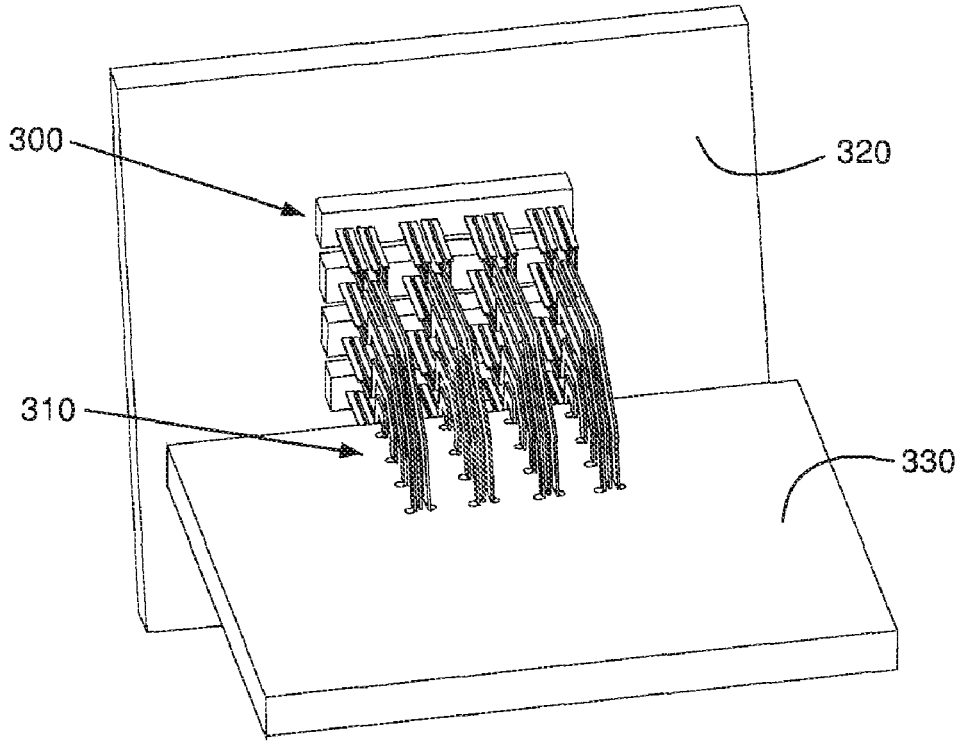
FIGS. 4A and 4B are perspective views of a mated connector system.
Figure 4B:
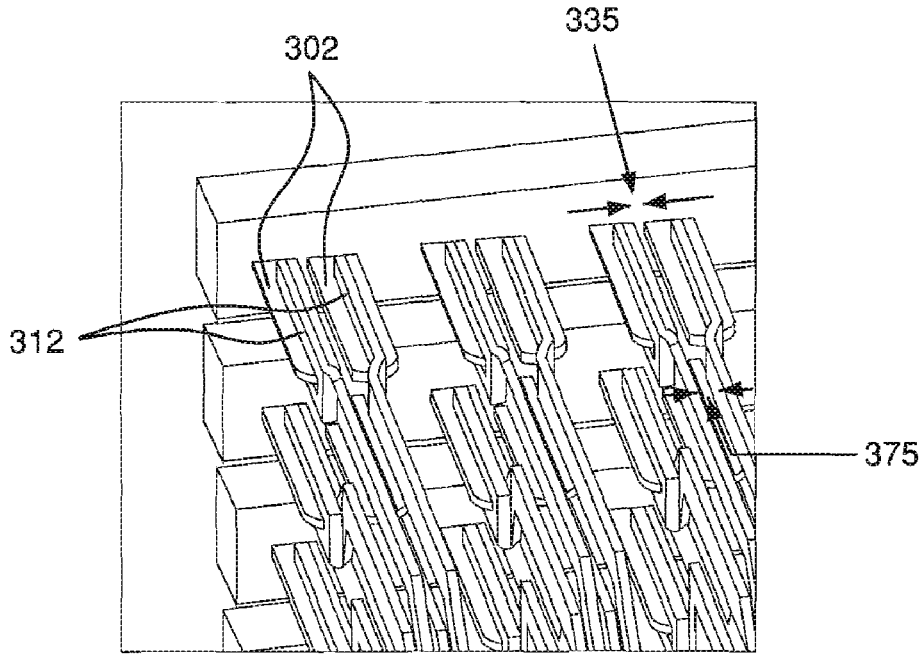

FIGS. 4A and 4B are perspective views of a broadside-to-edge-coupling interface for a connector system according to an embodiment. As shown in FIG. 4A, the connectors 300 and 310 may electrically couple the circuit boards 320 and 330. In particular, FIG. 4B depicts the broadside-to-edge coupling of the contacts 302 in the connector 300 to the contacts 312 in the connector 310. In addition, the contacts 302 in a differential signal pair may be separated by the gap 335 and the contacts 312 in a corresponding differential signal pair may be separated by the gap 375. As noted above, it may be advantageous to maintain a constant differential impedance profile along the length of each signal pair. Therefore, the dielectric coefficient and widths of the gaps 335 and 375 may be substantially equal.

What is claimed:

1. An electrical connector, comprising:

a broadside-coupled differential signal pair of electrical contacts, each contact of the broadside-coupled differential signal pair of electrical contacts comprising a respective lead portion and a respective mating interface portion, wherein the respective mating interface portions cooperate to enable a mating between an edge-coupled differential signal pair of electrical contacts and the broadside-coupled differential signal pair of electrical contacts, wherein each of the respective mating interface portions comprises a respective plurality of tines adapted to receive a respective one of the edge-coupled differential signal pair of electrical contacts, and wherein each of the respective plurality of tines is adapted to contact opposing sides of the respective one of the edge-coupled differential signal pair of electrical contacts.

2. The electrical connector of claim 1, wherein the edge-coupled differential signal pair of electrical contacts have respective broadsides that define a first plane, and wherein each of the respective plurality of tines defines a respective second plane that is substantially perpendicular to the first plane.

3. The electrical connector of claim 1, wherein each of the respective lead portions defines a respective first plane, and wherein each of the respective plurality of tines defines a respective second plane that is substantially parallel to, and offset from, the respective first plane.

4. The electrical connector of claim 3, wherein each contact of the edge-coupled differential signal pair of electrical contacts has a blade-shaped mating end.

5. The electrical connector of claim 1, wherein the respective lead portions have substantially the same length, and wherein a differential impedance between the respective lead portions is substantially constant along the lengths thereof.

6. The electrical connector of claim 5, wherein the electrical connector is a right-angle connector.

7. The electrical connector of claim 5, wherein the electrical connector is a mezzanine-style connector.

8. The electrical connector of claim 1, wherein the respective lead portions are broadside-coupled to one another and the respective mating interface portions are broadside coupled to one another.

9. An electrical connector, comprising:

an edge-coupled differential signal pair of electrical contacts, each contact of the edge-coupled differential signal pair of electrical contacts comprising a respective lead portion and a respective mating interface portion, wherein the respective lead portions are edge-coupled to one another and the respective mating interface portions are edge-coupled to one another, wherein the respective mating interface portions cooperate to enable a mating between the edge-coupled differential signal pair of electrical contacts and a broadside-coupled differential signal pair of electrical contacts, and wherein each of the respective mating interface portions comprises a respective receptacle, each receptacle being adapted to receive a respective one of the broadside-coupled differential signal pair of electrical contacts.

10. The electrical connector of claim 9, wherein each of the respective mating interface portions comprises a respective plurality of tines adapted to receive a respective one of the broadside-coupled differential signal pair of electrical contacts.

11. The electrical connector of claim 10, wherein each contact of the broadside-coupled differential signal pair of electrical contacts has a respective broadside that defines a respective first plane, and wherein each of the respective plurality of tines defines a respective second plane that is substantially perpendicular to the respective first plane.

12. The electrical connector of claim 10, wherein each of the respective lead portions defines a respective first plane, and wherein each of the respective plurality of tines defines a respective second plane that is substantially parallel to the respective first plane.

13. The electrical connector of claim 12, wherein each contact of the broadside-coupled differential signal pair of electrical contacts has a blade-shaped mating end.

14. An electrical connector, comprising:

a first contact comprising a first lead portion and a first interface portion; and a second contact adjacent to the first contact, wherein the second contact comprises a second lead portion and a second interface portion, wherein the first interface portion is adapted to receive a third contact having a broadside, wherein the first lead portion has a first outer surface that defines a first plane and the first interface portion has a second outer surface that defines a second plane, wherein the first and second planes are offset from one another via a transition between the first interface portion and the first lead portion, wherein a first distance between the first and second interface portions is greater than a second distance between the first and second lead portions, and wherein the broadside of the second contact defines a third plane that forms a non-zero angle with the first plane.

15. The electrical connector of claim 14, wherein the first interface portion comprises a plurality of tines, and the second contact comprises a blade contact.

16. The electrical connector of claim 14, wherein the first and second contacts comprise an edge-coupled differential signal pair of electrical contacts.

17. The electrical connector of claim 15, wherein the plurality of tines are adapted to contact opposing sides of the blade contact.

18. The electrical connector of claim 16, wherein the first and second lead portions are edge-coupled to one another and the first and second interface portions are edge-coupled to one another.

19. The electrical connector of claim 14, wherein the first and second contacts comprise a broadside-coupled differential signal pair of electrical contacts.

20. The electrical connector of claim 19, wherein the first and second lead portions are broadside-coupled to one another and the first and second interface portions are broadside-coupled to one another.

21. An electrical connector, comprising:

a broadside-coupled differential signal pair of electrical contacts, each contact of the broadside-coupled differential signal pair of electrical contacts comprising a respective lead portion and a respective mating interface portion, wherein the respective lead portions are broadside-coupled to one another and the respective mating interface portions are broadside coupled to one another, wherein the respective mating interface portions cooperate to enable a mating between an edge-coupled differential signal pair of electrical contacts and the broadside-coupled differential signal pair of electrical contacts, and wherein each of the respective mating interface portions comprises a respective plurality of tines adapted to receive a respective one of the edge-coupled differential signal pair of electrical contacts.

22. The electrical connector of claim 21, wherein the edge-coupled differential signal pair of electrical contacts have respective broadsides that define a first plane, and wherein each of the respective plurality of tines defines a respective second plane that is substantially perpendicular to the first plane.

23. The electrical connector of claim 21, wherein each of the respective lead portions defines a respective first plane, and wherein each of the respective plurality of tines defines a respective second plane that is substantially parallel to, and offset from, the respective first plane.

24. The electrical connector of claim 21, wherein each contact of the edge-coupled differential signal pair of electrical contacts has a blade-shaped mating end.

25. The electrical connector of claim 21, wherein the respective lead portions have substantially the same length, and wherein a differential impedance between the respective lead portions is substantially constant along the lengths thereof.

26. The electrical connector of claim 21, wherein the electrical connector is a right-angle connector.

27. The electrical connector of claim 21, wherein the electrical connector is a mezzanine-style connector.

28. The electrical connector of claim 21, wherein each of the respective plurality of tines is adapted to contact opposing sides of the respective one of the edge-coupled differential signal pair of electrical contacts.

* * * * *